US005462443A

United States Patent [19]

Kurbjuhn et al.

[11] Patent Number: 5,462,443

[45] Date of Patent: Oct. 31, 1995

[54] PLUG-TYPE CONNECTOR

[75] Inventors: Klaus Kurbjuhn, Bocholt; Heinz-Dieter Mueller, Emmerich, both of Germany

[73] Assignee: Siemens Aktiengesellschaft, Munich, Germany

[21] Appl. No.: 388,619

[22] Filed: Feb. 13, 1995

Related U.S. Application Data

[63] Continuation of Ser. No. 200,433, Feb. 23, 1994, abandoned.

[30] Foreign Application Priority Data

Feb. 26, 1993 [DE] Germany ..... 9302836 U

[51] Int. Cl.[6] ..... H01R 9/09

[52] U.S. Cl. ..... 439/78; 439/862

[58] Field of Search ..... 439/86.2, 78, 79, 439/80, 81, 67, 77, 329

[56] References Cited

U.S. PATENT DOCUMENTS

| | | | |
|---|---|---|---|
| 4,003,617 | 1/1977 | Witek, Jr. et al. | 439/80 OR |
| 4,037,898 | 7/1977 | Guyette | 439/78 X |
| 4,449,165 | 5/1984 | Kaufman | 439/78 X |
| 4,979,903 | 12/1990 | Gosselin | 439/78 X |
| 4,991,666 | 2/1991 | Septfon et al. | 439/81 X |

*Primary Examiner*—David L. Pirlot
*Assistant Examiner*—Daniel Wittels
*Attorney, Agent, or Firm*—Hill, Steadman & Simpson

[57] ABSTRACT

Plug-type connector for producing a contact connection between a flat module (i.e., a printed circuit board) and a component part (i.e., a loudspeaker) having electrical terminals. The plug-type connector can be quickly connected to the flat module in a problem-free manner. The plug-type connector can be attached in the desired direction of assembly so that robotics can be used in the fabrication. The plug-type connector is designed as an essentially U-shaped part that can be plugged onto the edge region of the flat module. The legs of the plug-type connector have hook-shaped, projecting securing portions directed toward one another that electrically contact with contact pads or tracks applied on the flat module.

9 Claims, 4 Drawing Sheets

PLUG-TYPE CONNECTOR

This is a continuation of application Ser. No. 08/200,433, filed Feb. 23, 1994, now abandoned.

BACKGROUND OF THE INVENTION

1. Field of the Invention

The present invention is directed generally to a connector and specifically to a plug-type connector for producing a contact connection between a flat module and a further component part having electrical terminals.

2. Description of the Related Art

In known flat modules (e.g., printed circuit boards) previously used, plug pins were pressed into the printed circuit board and subsequently soldered in an additional step to produce a plug-type connection. Thus, the terminal region of these plug pins is located at the components' side of the flat module.

During an automated fabrication of, for example, a telephone apparatus, equipped flat modules as well as additional component parts (for example, loudspeakers) are joined in a specific sequence. The plug connections required for the additional component parts should preferably be located in the joining direction to facilitate assembly of the individual modules or component parts. Since the terminal region of the plug pins, however, is located at that side of the flat module facing away from the joining direction, the plugs allocated to the loudspeaker, for example, must be manually attached to the plug pins.

SUMMARY OF THE INVENTION

It is an object of the present invention to provide a plug-type connector that can be quickly connected to the flat module in an efficient and a problem-free manner.

It is a further object to provide a plug-type connector that can be attached in the desired direction of assembly so that automated robotics can be used in the fabrication thereof.

The present invention provides a plug-type connector constructed in an essentially U-shaped component part that can be plugged onto the edge region of a flat module, whereby the legs of the plug-type connector have projecting securing portions, such as a tab cut-out that electrically connect to contact pads or tracks on the flat module.

The objects of the present invention are inventively achieved in a plug-type connector for producing an electrical connection between a flat module with contact pads or tracks and a further component part with electrical terminals, having a substantially U-shaped, resilient component part with legs spaced to fit over the contact pads or tracks disposed on an edge region of the flat module, each of the legs having hook-shaped, projecting securing portions directed toward one another for insuring electrical contact between the pads or tracks of the flat modules and the U-shaped resilient component, and the U-shaped resilient component has means for mechanically and electrically contacting the further component part.

Given a plug-type connector of the type cited above, the spacing of the legs relative to one another can be dimensioned to be somewhat less than the thickness of the flat module or printed circuit board onto which the plug-type connector is applied. The hook-shaped, projecting securing portions provided in the legs and directed toward one another penetrate through the surface of the contact pad or track and thereby provide an intimate electrical and mechanical connection with the contact track or pad. Moreover, these hook-shaped, projecting securing portions prevent an undesired detachment of the plug-type connector from the edge region of the flat module. The projecting securing portions act as a lock in the pull-off direction. Also, a cable can be directly connected by soldering to a plug-type connector of the type initially cited.

According to a preferred embodiment, one of the legs can be connected to a contacting region. When this contacting region is designed, for example, as a solder or plug contact, then the contact connection to the further component part can be directly soldered or plugged with a suitable plug-in socket. In addition, the contacting region joined to a plug-type connector can also be designed as an insulation displacement contact that allows an insulated, electrical conductor to be connected without being stripped and without additional measures such as, for example, soldering. Further, two inventively designed plug-type connectors can be connected to one another to form a one piece connector, so that, for example, two flat modules can be joined to one another.

The invention shall be set forth in greater detail below with reference to the figures and to the exemplary embodiments.

DETAILED DESCRIPTION OF THE PRESENTLY PREFERRED EMBODIMENTS

Figure 2:
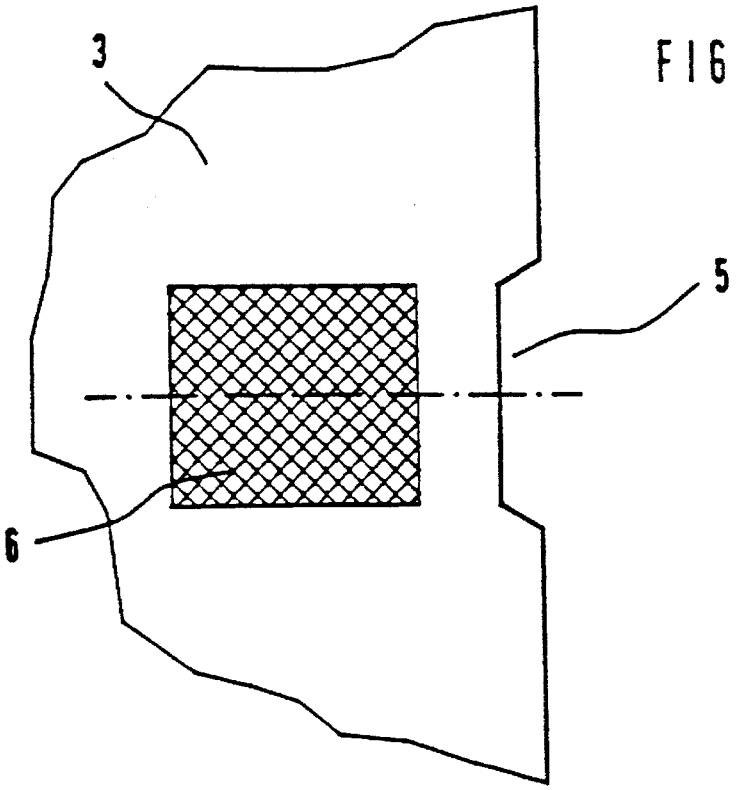
FIG. 2 is a plan view of a sub-region of the flat module without the plug-type connector of the present invention.

A plug connection between a flat module and a further connection to a component part can be produced in a simple way with the plug-type connector of the present invention shown in the figures. To this end, the plug-type connector 1 is designed as an essentially U-shaped component part that is pushed onto the edge region 2 of a flat module 3. In order to achieve a flush termination of the plug-type connector 1 with the edge region 2 of the flat modules 3, the flat module 3 has a recess 5 adapted to the shape and thickness of the material of the base 4 of the plug-type connector (FIG. 2). A contact pad 6 or contact track of electrically conductive material such as tin, for example, is provided on the flat module 3. Thus, an electrical connection with the plug-type connector 1 is provided.

Figure 1:
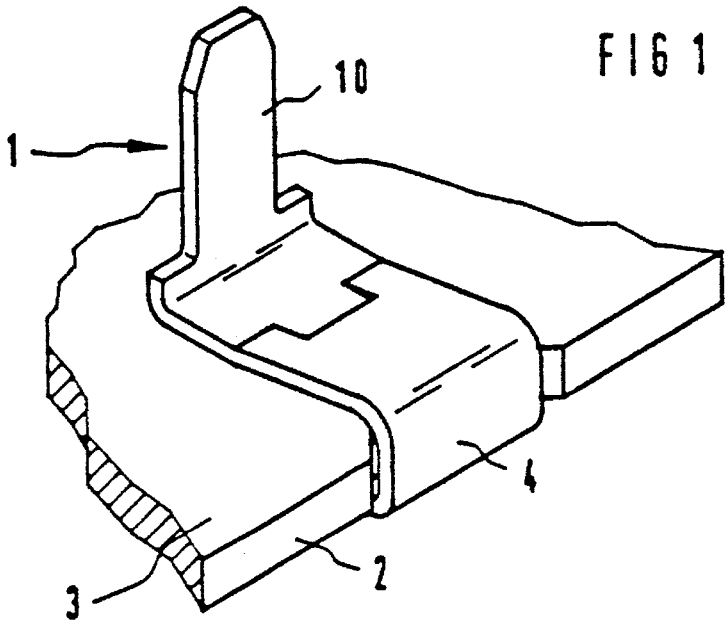
FIG. 1 is a perspective view of the plug-type connector of the present invention applied on a sub-region of a flat module.
Figure 3:
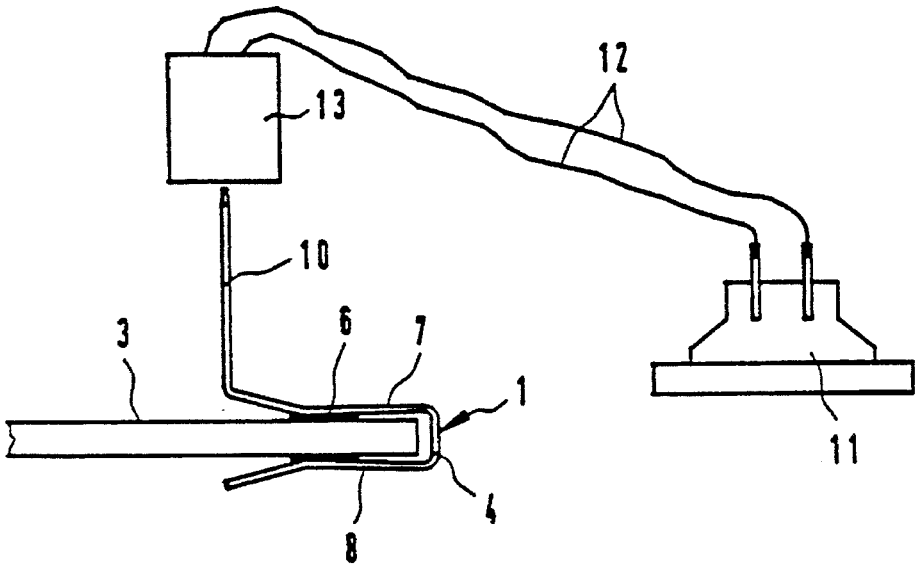
FIG. 3 is an applied example of the plug-type connector of the present invention.

Referring to FIG. 3, two resilient legs 7 and 8 of the plug-type connector 1 each have respective hook-shaped projecting securing portions 9 (see FIG. 6) directed toward one another. When the plug-type connector 1 is applied to the flat module 3, each hook-shaped, projecting securing portion 9 penetrates through the surface of the contact pad 6 or track and thus effects a reliable contact. The spacing of the legs 7 and 8 from one another is somewhat less than the thickness of the flat module 3 in this region. At the same time, these projecting securing portions 9 prevent an undesired pull-off of the plug-type connector from the edge region 2 of the flat module 3. The leg 7 further comprises a one-piece contact region connected to it that is designed as a plug contact 10 or solder contact in the exemplary embodiments of FIGS. 1, 3 and 5.

FIG. 3 shows a plugged connection between a flat module 3 and a component, for example a loudspeaker 11, with the plug-type connector 1 of the invention. The loudspeaker 11 is connected via the leads 12 to the plug-in socket 13. This plug-in socket 13 is pushed onto the contact region of the plug-type connector 1 which in this embodiment is designed as a plug contact 10.

Figure 4:
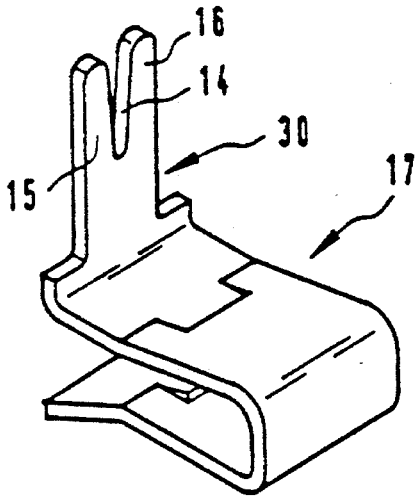
FIG. 4 is the plug-type connector of the invention designed as an insulation displacement contact.

FIG. 4 shows a plug-type connector 17 whose contact region is designed as an insulation displacement contact. For contacting a conductor, this contact region has a pinch slot 14 whose inside clearance is somewhat less than the thickness of the conductor core. When an insulated, electrical conductor is pressed into the pinch slot 14, the insulation of the conductor is parted at opposite sides with cutter jaws 15 and 16 that limit the pinch slot and the core of the conductor is thereby seated against the cutter jaws 15 and 16.

Figure 5:
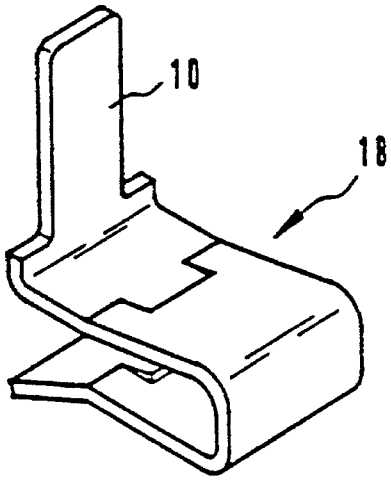
FIG. 5 is the plug-type connector of the present invention designed as a solder or plug contact.
Figure 6:
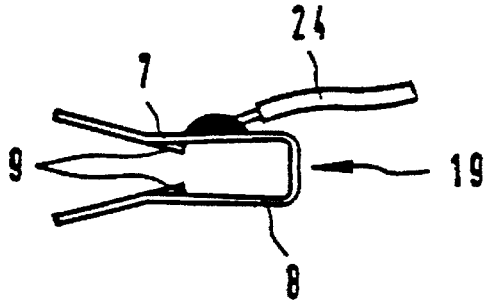
FIG. 6 is the plug-type connector of the present invention directly connected to a lead.

In the plug-type connector 18 shown in FIG. 5, the contact region is designed as a plug contact 10 or solder contact, whereas the plug-type connector of FIG. 6 does not have a separate contact region. A conductor 24 is directly secured to the plug-type connector 19 by soldering in this embodiment.

Figure 7:
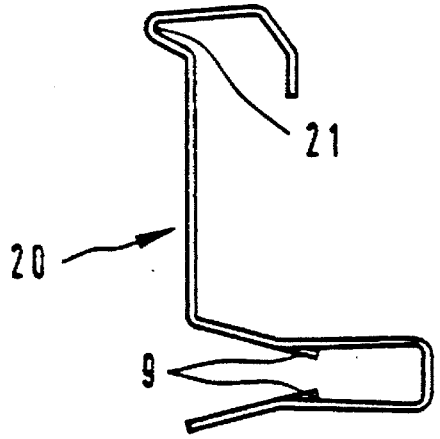
FIG. 7 is an embodiment of the plug-type connector of the invention for directly contacting a component part.

The embodiment of FIG. 7 is a plug-type connector 20 with which terminals of component parts can be directly contacted, i.e. the contacted region 21 is pre-stressed so that it presses against the terminal of the component part (not shown here).

Figure 8:
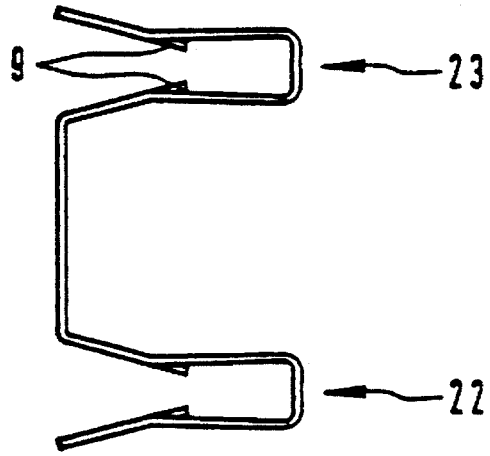
FIG. 8 is a further embodiment of the plug-type connector as a multiple connector.

FIG. 8 shows a further embodiment of the plug-type connector of the invention. In this embodiment, two plug-type connectors 22 and 23 are joined to one another in one piece. This combined dual-connector embodiment electrically connects two printed circuit boards to one another. The printed circuit boards are at a distance from one another and also have contact tracks or contact pads.

Figure 9:
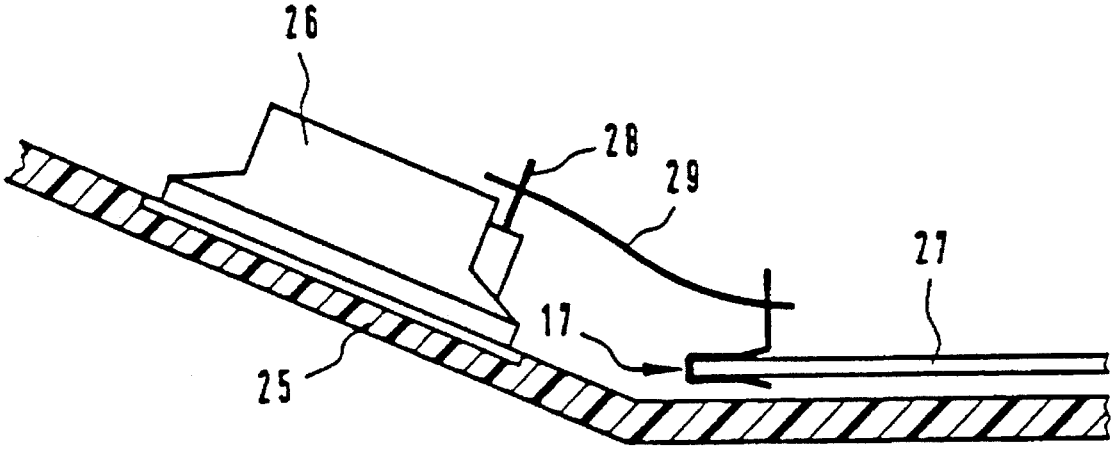
FIG. 9 is shows a further embodiment of the plug-type connector of FIG. 4.

FIG. 9 shows an embodiment of the plug-type connector of FIG. 4 within a partially illustrated telephone station. A loudspeaker 26 can be connected to a flat module 27 having component parts in an optimal way inside the housing 25 of a telephone station. To this end, the loudspeaker 26 has insulation displacement contacts 28 serving as electrical terminals. The contacting region of these insulation displacement contacts 28 is thereby designed in the same way as the insulation displacement contact 30 shown and described in FIG. 4. The aforementioned flat module 27 on whose edge region the plug-type connector 17 of FIG. 4 is applied is also arranged inside the telephone station.

For electrical connection of the loudspeaker 26 to the flat module 27 in this exemplary embodiment, an insulated electrical conductor 29 is merely pressed into the pinch slots of the respective insulation displacement contact 28 at the loudspeaker 26 as well as that of the plug-type connector 17 in the edge region of the flat module 27. The insulation of the conductor 29 is respectively parted during this procedure and an intimate contact between the conductor and the insulation displacement contacts is produced.

Although other modifications and changes may be suggested by those skilled in the art, it is the intention of the inventors to embody within the patent warranted hereon all changes and modifications as reasonably and properly come within the scope of their contribution to the art.

We claim:

1. Plug-type connector for producing an electrical connection between a flat module having contact pads or tracks and a further component part having electrical terminals, comprising:

a substantially U-shaped, resilient component part having colinear and coplanar legs spaced to fit over said contact pads or tracks disposed on an edge region of said flat module without penetrating said flat module;

each of said legs having hook-shaped, projecting securing portions directed toward one another to assure electrical and physical contact between said pads or tracks of said flat module and said U-shaped resilient component with said hook-shaped securing portions contacting opposite sides of said flat module; and said U-shaped resilient component having means for mechanically and electrically contacting said further component part.

2. Plug-type connector according to claim 1, further comprising a contacting region connected to one of said legs of said U-shaped resilient component part.

3. Plug-type connector according to claim 2, wherein said contacting region is a plug contact.

4. Plug-type connector according to claim 2, wherein said contacting region is a solder contact.

5. Plug-type connector according to claim 2, wherein said contacting region is an insulation displacement contact.

6. Plug-type connector according to claim 2, wherein said contacting region is a pre-stressed contact element.

7. Plug-type connector according to claim 1, wherein said plug-type connector comprises two of said U-shaped resilient component parts connected to one another to form one piece, said U-shaped resilient component parts being disposed at a distance from one another.

8. Plug-type connector according to claim 2, wherein said contacting region is connected to one of said legs at a distance from the vertex of said U-shaped, resilient component part so that said contacting region is disposed within the area of said flat module and is spaced a distance from the edge of said flat module.

9. Plug-type connector for producing an electrical connection between a flat module having contact pads or tracks and a further component part having electrical terminals, comprising:

a substantially U-shaped, resilient component part having colinear and coplanar legs spaced to fit over said contact pads or tracks disposed on an edge region of said flat module without penetrating said flat module;

each of said legs having projecting, securing portions directed toward one another and constructed and arranged to extend between the legs of the U-shaped, resilient component part, the securing portions assuring electrical and physical contact between said pads or tracks of said flat module and said U-shaped resilient component with said projecting, securing portions contacting opposite sides of said flat module; and said U-shaped resilient component having means for mechanically and electrically contacting said further component part.

* * * * *